US006634430B2

(12) United States Patent
Dawson et al.

(10) Patent No.: US 6,634,430 B2
(45) Date of Patent: Oct. 21, 2003

(54) METHOD FOR INSTALLATION OF EVACUATED TUBULAR CONDUITS

(75) Inventors: Charles R. Dawson, Houston, TX (US); Mark W. Biegler, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/313,770

(22) Filed: Dec. 6, 2002

(65) Prior Publication Data

US 2003/0116324 A1 Jun. 26, 2003

Related U.S. Application Data

(60) Provisional application No. 60/342,813, filed on Dec. 20, 2001.

(51) Int. Cl.[7] ..... E21B 43/10

(52) U.S. Cl. ..... 166/381; 166/380; 166/386; 166/192

(58) Field of Search ..... 166/381, 386, 166/380, 77.1, 191, 192, 285, 165

(56) References Cited

U.S. PATENT DOCUMENTS

| | | | | | |
|---|---|---|---|---|---|
| 3,398,794 | A | * | 8/1968 | Fox, Jr. | 166/67 |
| 3,526,280 | A | | 9/1970 | Aulick | 166/285 |
| 3,572,432 | A | | 3/1971 | Aulick | 166/114 |
| 3,595,257 | A | * | 7/1971 | McMahon | 137/1 |
| 4,308,917 | A | * | 1/1982 | Dismukes | 166/381 |
| 4,360,290 | A | * | 11/1982 | Ward | 405/170 |
| 4,384,616 | A | | 5/1983 | Dellinger | 166/376 |
| 4,984,631 | A | * | 1/1991 | Reesing | 166/115 |
| 4,986,361 | A | | 1/1991 | Mueller et al. | 166/381 |
| 5,117,915 | A | | 6/1992 | Mueller et al. | 166/381 |
| 5,150,756 | A | * | 9/1992 | Hassanzadeh | 166/318 |
| 5,181,571 | A | | 1/1993 | Mueller et al. | 166/381 |
| 5,456,317 | A | * | 10/1995 | Hood et al. | 166/296 |
| 5,829,526 | A | * | 11/1998 | Rogers et al. | 166/291 |
| 6,131,656 | A | * | 10/2000 | Jani | 166/192 |
| 6,505,685 | B1 | * | 1/2003 | Sullaway et al. | 166/386 |

* cited by examiner

*Primary Examiner*—William Neuder
*Assistant Examiner*—T. Shane Bomar
(74) *Attorney, Agent, or Firm*—Denise Y. Wolfs; Gary P. Katz

(57) ABSTRACT

A method of installing tubular conduits (e.g. casing, liners, sand screens) into a highly deviated borehole. A lower plug is attached at one end of a portion of a tubular conduit. This end is inserted into a borehole. After insertion of the length of conduit intended to be buoyancy-aided into the borehole, an inflatable plug insert is attached at the upper end. The inflatable plug has a built-in valve designed to enable fluid communication between the buoyancy-aided tubular section and the insertion string. A pump is attached to the built-in valve and the fluid within the section intended to be buoyancy-aided is removed, after which the built-in valve is closed. The buoyancy provided by the evacuated section enables insertion of the tubular conduit into boreholes greatly deviated from the vertical, reducing running drag and the risk of the tubular becoming differentially stuck. After the tubular conduit is inserted to the desired depth, the built-in valve is opened allowing the fluid above the plug insert to fill the buoyancy-aided section. Conventional well construction activities then resume.

13 Claims, 3 Drawing Sheets

METHOD FOR INSTALLATION OF EVACUATED TUBULAR CONDUITS

This application claims the benefit of U. S. Provisional Application No. 60/342,813 filed on Dec. 20, 2001.

FIELD OF THE INVENTION

This invention relates generally to the field of well drilling and, in particular, to installation of casing or liners into oil and gas wellbores. Specifically, the invention is an improved method of flotation of these well tubulars into highly deviated wellbores.

BACKGROUND OF THE INVENTION

Tubular conduits, such as casing, liners or sand exclusion devices, often need to be inserted into a portion of the borehole during drilling or well, completion. In some cases, insertion of these tubular conduits is problematic because of the significant drag forces created by contact between the conduit and the walls of the borehole. Borehole characteristics that tend to result in such detrimental contact are high deviation (measured from the vertical/gravity axis), extended horizontal reach (relative to the surface location of the well or mudline location of the well in the case of an offshore well), and a subsurface trajectory that features frequent or relatively severe changes in well angle or direction.

Numerous problems result from excessive contact between the conduit and the walls of the borehole. This contact creates frictional drag, which increases the downward force necessary to install the conduit. If sufficient additional axial force cannot be applied, the result will be a stuck conduit and possible effective loss of the well. The application of additional axial force can also result in damage to the conduit itself (deformation, buckling, and possibly rupture).

Another problem associated with excessive contact between the conduit and the borehole walls is that the conduit may become 'differentially stuck'. This occurs when the conduit makes contact with the wall of the borehole in a permeable section of the formation. The pressure differential between the fluids in the borehole and the fluids in the formation results in a pressure force, which acts to push the conduit toward the borehole wall with which it is in contact. This pressure differential increases the downward force required to push the conduit further into the borehole, with the same resulting problems as those associated with significant frictional drag.

Common installation methods include attempts to overcome or minimize the problems caused by significant conduit to borehole wall contact through the use of low-density fluids to create buoyancy in the deeper section of the conduit. These known string flotation methods require added delay and well completion steps in order to avoid having a loss of well pressure or 'kick' when removing the low-density fluids from the conduit. Such prior attempts are disclosed in U.S. Pat. No. 3,526,280 (Aulick), U.S. Pat. No. 4,384,616 (Dellinger), and U.S. Pat. No. 5,117,915 (Mueller).

As is illustrated in U.S. Pat. No. 3,526,280 (Aulick) a related well completion operation is outlined therein for highly deviated wells. Cement slurry is first pumped down into the borehole to partially displace and replace the mud slurry. The lower portion of the casing string, with a float shoe (and optionally a float collar) at the bottom end, is filled up with fluid (liquid or gas, including air) of lower density than the cement slurry, thereby providing a buoyancy effect to the lower chamber of the casing string. Where it is desirable to confine the buoyant fluid within only a portion of the casing string, a retrievable bridge plug may be positioned a substantial distance above the float shoe. Centralizers are further provided throughout the length of the casing string to minimize contact of the casing string to the borehole wall. Once the casing string has been inserted to the desired depth, the equalizing valve in the bridge plug is opened to allow the fluid above the bridge plug into the buoyancy section. The low-density fluid flows out of the buoyancy section, through the equalizing valve and up the casing string.

A similar well completion operation is illustrated in U.S. Pat. No. 5,117,915 (Mueller). This process attaches a float shoe/float collar to the end of a section of casing string. A buoyant "floating" portion of the casing string is created by trapping air between the float shoe/float collar and a shear-pinned plug insert. This insert includes a releasable plug (attached by a first set of shear pins) to block a passageway in the body of the insert and contain the air in the buoyancy-aided section of the casing string. Once the casing string has been inserted to the desired depth, the releasable plug in the shear-pinned plug insert is opened to allow the fluid above the plug insert to flow into the buoyancy section. The low-density fluid (air) flows out of the buoyancy-aided section, through the equalizing valve and up the casing string. While Mueller makes no suggestion of the use of centralizers and limits the low-density fluid to air, the thrust of the method is the same as in Aulick and shares the same deficiencies.

The two major deficiencies in both the Aulick and Mueller methods involve the removal of the low-density fluids used to create buoyancy. Significant delays can be created by waiting for the low-density fluid to rise to the top of the casing string. In addition, if the buoyed section is highly deviated, as in the case of a horizontal production well, the light fluid may not migrate up the tubular for removal, as noted by Mueller. Incomplete removal of the low-density fluid results in problematic loss of borehole pressure, described more fully below, as the fluids are eventually released into the annulus between the conduit and the borehole walls.

The method illustrated in U.S. Pat. No. 4,384,616 (Dellinger) also teaches the use of buoyancy-aided insertion of well casing. After providing a means to plug the ends of a pipe string portion, the plugged portion is filled with a low-density, miscible fluid. Once the pipe string has been inserted to the desired depth, the plugs are drilled out and the low-density miscible fluid is forced into the annulus between the pipe string and the wellbore. The low-density fluid must be miscible with the wellbore fluids and the formation to avoid a burp or "kick" to or from the formation outside the pipe string. If the light fluid is not miscible with respect to the mud in the borehole and is circulated down the tubular conduit through the lower plug into the casing-by-borehole annulus for the purpose of removal, the lower density of the light fluid will reduce the pressure in the borehole relative to the borehole formation pressure. This can lead to a problematic influx of formation fluid into the borehole. If the light fluid is a gas, and this light fluid is similarly circulated into the casing-by-borehole annulus, the gas can also transmit pressure along the length of the gas bubble, which can be further problematic from a well control perspective, and must be circulated out, requiring no further progress in borehole construction until the gas is circulated up the conduit-by-borehole annulus to the surface. For wells of great depth the time required to make this circulation can be significant. The added expense and difficulties of filling the entire buoyant section with low-density miscible fluid have apparently resulted in little or no commercially practical application of this buoyancy-aided insertion method.

Another buoyancy-aided method used to install tubulars in boreholes that feature these characteristics is to fill an annulus between a concentric insertion tubular string and the casing (or liner) with a fluid (a liquid or a gas) that has a lower density than the liquid contained inside the borehole. Similar to the methods described above, buoyancy created by the difference in the fluid density in the insertion-string-by-casing annulus and the density of the fluid in the borehole reduces the net weight of the tubular section as it is inserted into the borehole. The main advantage gained by use of the annulus buoyancy chamber method is that it allows drilling mud to be circulated, through the insertion string, during insertion or other operations. This method is also described in detail in U.S. Pat. No. 5,117,915 (Mueller).

Accordingly, there is a need for a tubular insertion methodology that will enable buoyancy-aided insertion of tubulars within a wellbore while avoiding the added expense, complexities and delays inherent in the currently known methods.

SUMMARY OF THE INVENTION

This invention provides a method for buoyancy-aided insertion of a tubular conduit into a borehole by removing the fluids from a section of the conduit, thus creating at least a partial vacuum in a section of the conduit. The density difference between the fluid residing in the borehole and the evacuated conduit section results in partial or full buoyancy of the evacuated section of tubular conduit. A preferred embodiment is to form this vacuum between a lower plug and an upper plug in the conduit, or in the annulus between an insertion string and the conduit, between lower and upper annular plugs. The terms 'upper' and 'lower' refer to the plugs' relative location while the conduit is within the vertical section of the borehole, the plugs keep their respective labels even under borehole deviation greater than 90 degrees. Once the tubular is in place, the barrier between the evacuated section and the borehole or insertion string fluids is eliminated, allowing these fluids to fill the evacuated interval. These fluids would then be replaced from the surface, with no need to remove any low-density fluid through the conduit or the borehole.

BRIEF DESCRIPTION OF THE DRAWINGS

The present invention and its advantages will be better understood by referring to the following detailed description and the attached drawing in which.

DESCRIPTION OF THE PREFERRED EMBODIMENT

In the preferred embodiment, the inventive method utilizes a vacuum created within a plugged section of a tubular conduit to provide buoyancy as the conduit is inserted into a borehole filled with fluid. As it is impossible to create a perfect vacuum, the term vacuum means evacuation to the extent practical.

Figure 1:
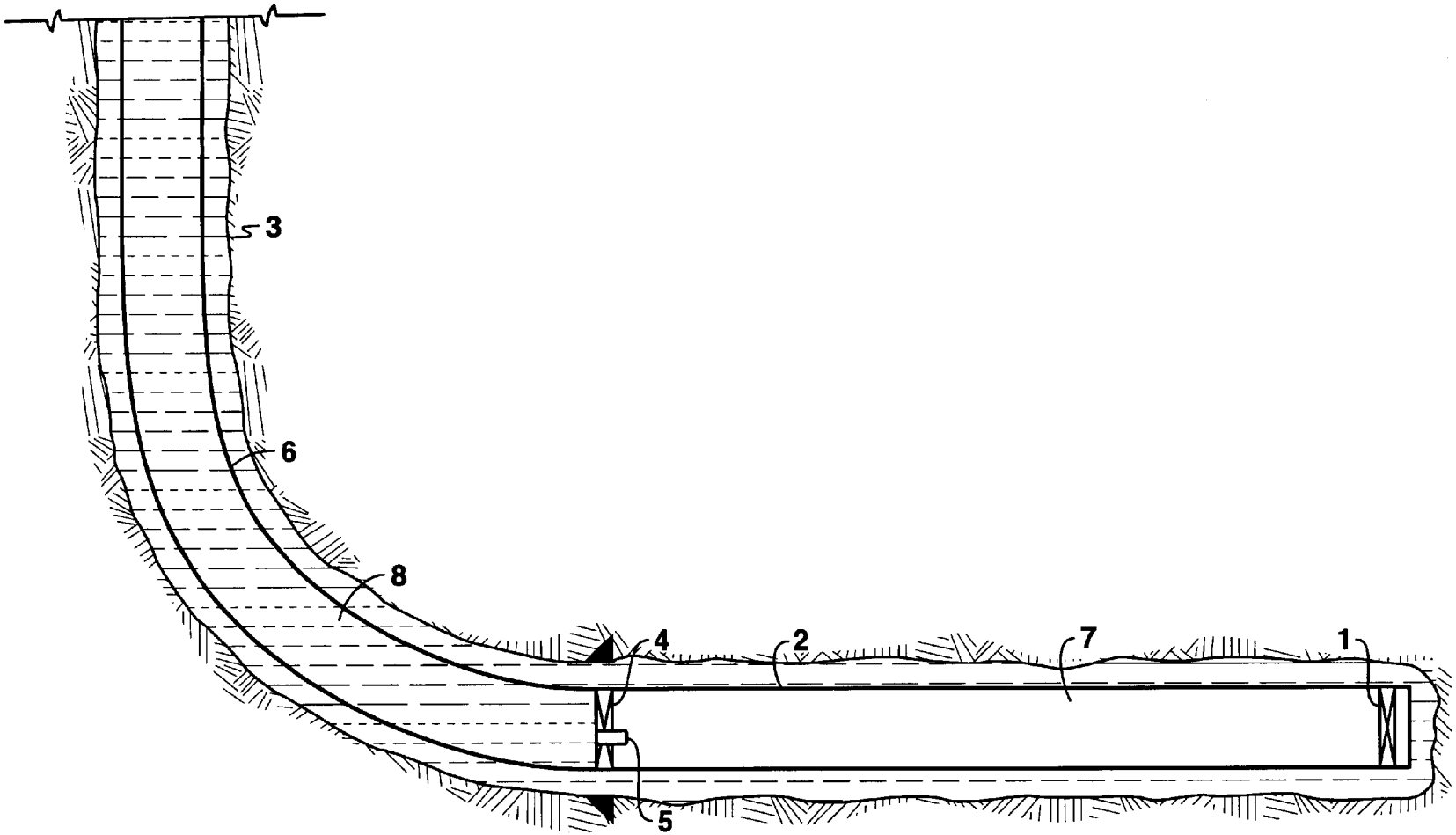
FIG. 1 is a cross sectional illustration of an embodiment of the current invention for buoyancy-aided conduit insertion wherein the section evacuated consists of the space within the conduit between an upper plug and a lower plug.

FIG. 1 illustrates the preferred embodiment of the current invention. First, a lower plug 1 is placed within the deepest part of the conduit 2 while this part of the conduit is at the surface. More conduit 2 is assembled on the top of the conduit 2 hanging in the well while the conduit 2 is inserted piecewise into the hole 3. Air is allowed to remain in the conduit 2 as it is run into the well. Once the entire section 7 of conduit that will be evacuated is hanging in the well from the surface, the upper plug 4 is inserted in the conduit. Then a vacuum, as defined above, is achieved by removing the air trapped in the section 7 of conduit between the lower 1 and upper 4 plugs. The completeness of the achieved vacuum between the plugs is dependent upon the effectiveness of available practical evacuation methods. These methods may include venturi-type suction devices, rotary pumps, vapor pumps, or any other suction or vacuum devices. Under this embodiment, the suction device is temporarily attached to a valve 5 affixed in the upper plug of the conduit, while the upper plug is exposed at the surface. The air contained within the conduit section 7 is drawn out, the valve 5 in the upper plug closed, and the suction device is removed. The casing is then run into the hole 3. After the conduit reaches the desired final position, the barrier imposed by the upper plug 4 is then removed. The plug 4 may be designed so that it collapses or slides to the lower end of the conduit, when exposed to pressure above a certain threshold or alternatively the plug 4 may be designed so that the application of pressure above a certain threshold opens a valve 5 in the upper plug. The fluid 8 in the section of conduit 6 above the upper plug 4 flows into the evacuated section 7, being replaced in the top section 6 from the surface. Conventional well construction activities then resume.

Figure 2:
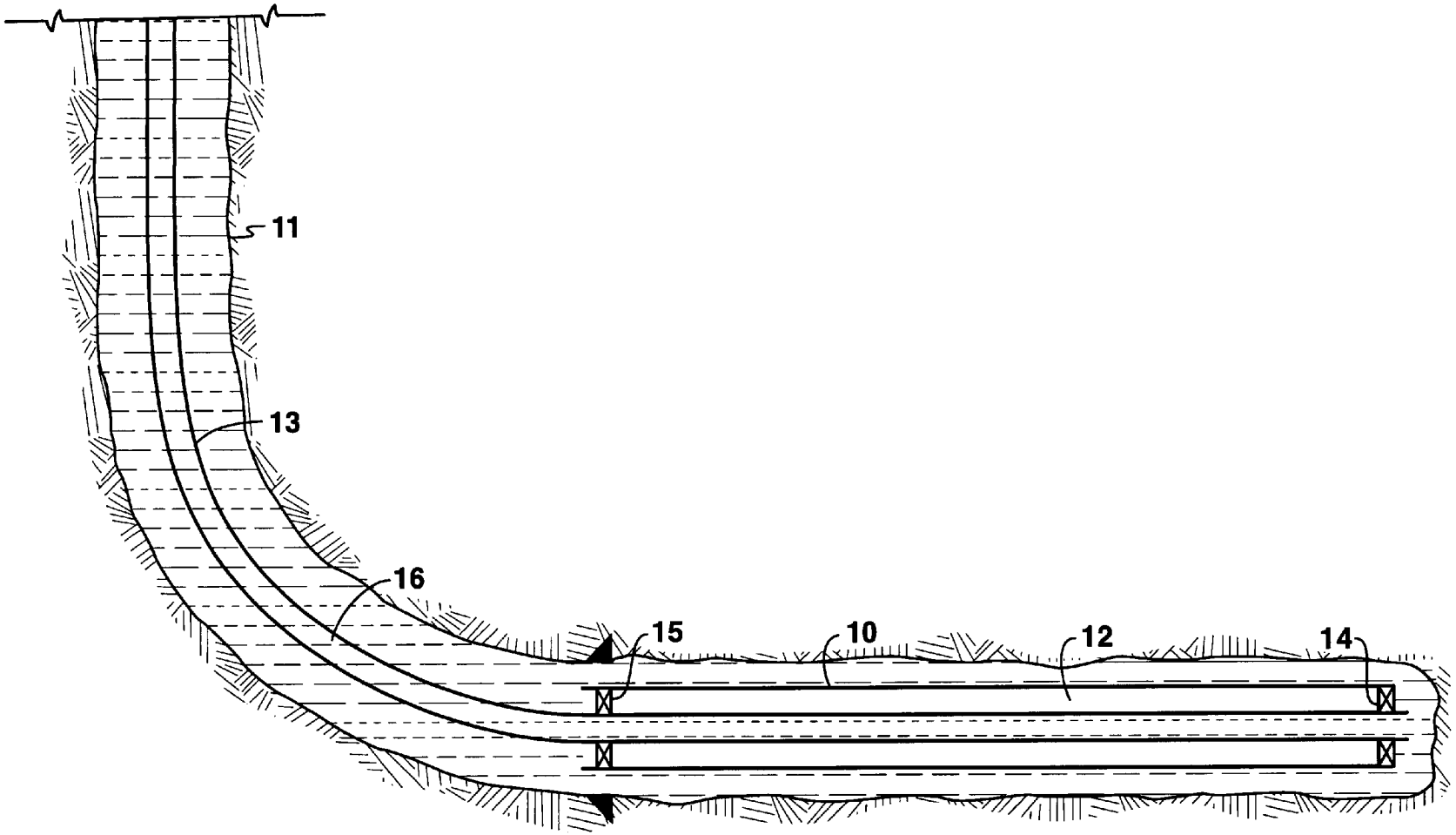
FIG. 2 is a cross sectional illustration of a second embodiment of the current invention for buoyancy-aided conduit insertion wherein the section evacuated consists of the space within the annulus, between the insertion string and the tubular conduit, between an upper plug and a lower plug.

FIG. 2 illustrates another possible embodiment of the invention that includes the potential to circulate drilling fluids during insertion of a tubular conduit 10 into a borehole 11. Using methods similar to those described above, the annulus 12 between an insertion string 13 run within the conduit 10, and lower annular plug 14 and upper annular plug 15 is evacuated. Once the insertion of the conduit 10 within the borehole 11 is completed, this method allows fluid 16 to fill the evacuated annulus 12 by withdrawing the insertion sting 13 from the lower plug 14. In this case, fluid 16 fills the annulus 12 from both the insertion string 13 and the borehole 11. Conventional well construction activities would then resume.

Figure 3:
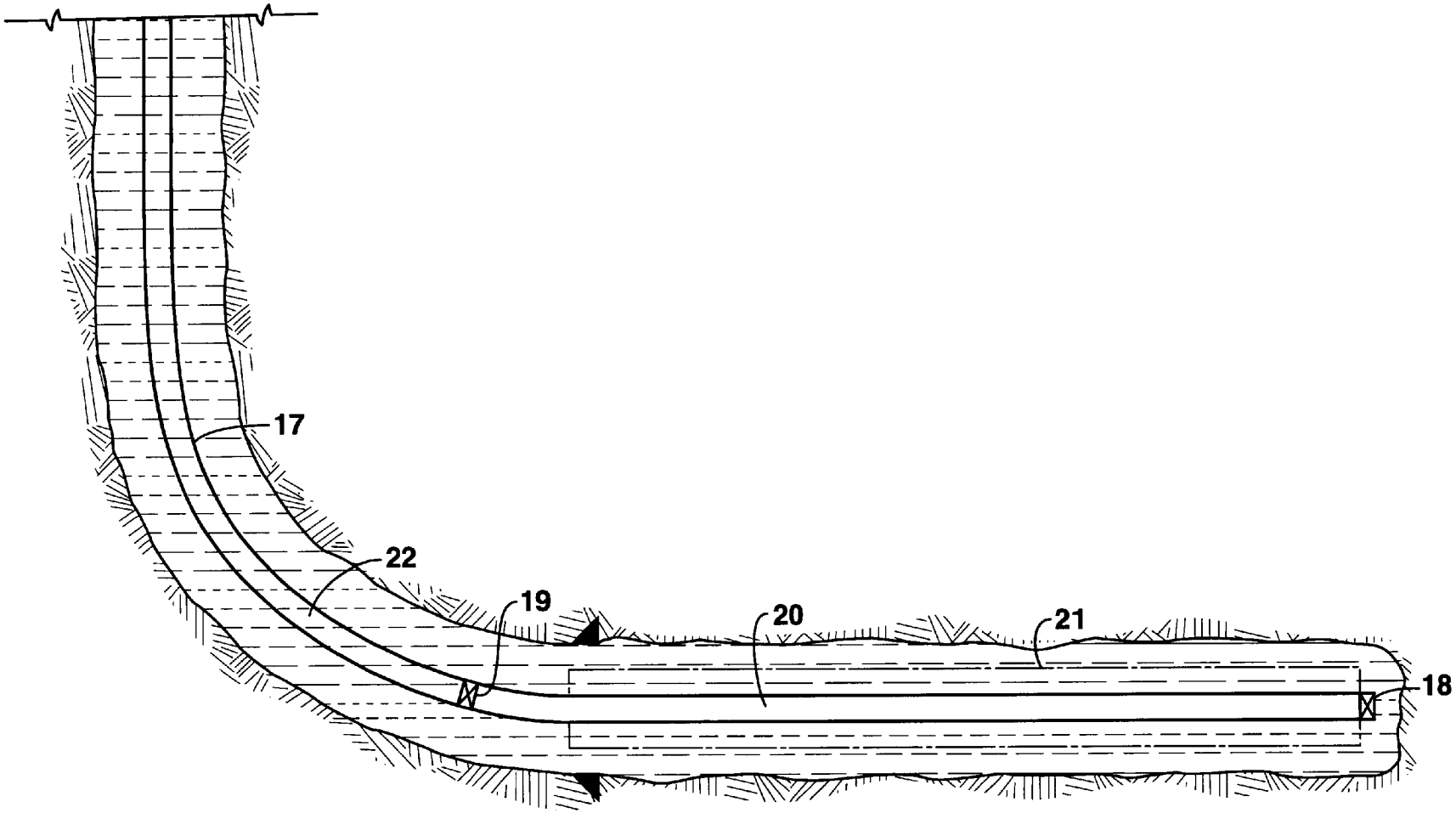
FIG. 3 is a cross sectional illustration of a third embodiment of the current invention for buoyancy-aided conduit insertion wherein the section evacuated consists of the space within the insertion string between an upper plug and a lower plug.

FIG. 3 illustrates a variation of the current invention applied to the insertion of conduit sections such as sand exclusion devices within boreholes. Sand exclusion devices are perforated and therefore cannot be used to contain a vacuum. In this embodiment, a vacuum is achieved in the insertion string 17, between a lower plug 18 and an upper plug 19. While this evacuated section 20 of the insertion string 17 will not afford as much buoyancy as a larger-diameter evacuated section, the buoyancy forces created may allow insertion of a conduit section 21 in cases where insertion would otherwise not be practical. Once the conduit section 21 has been inserted, the upper plug 19 is removed and fluid 22 is allowed to fill the evacuated section 20 with these fluids being replaced from the surface. The insertion string 17 would then be removed. Conventional well construction activities would then resume.

EXAMPLE 1 (COMPARATIVE)

A tubular conduit is inserted without rotation into a borehole at an inclination of 90 degrees relative to vertical. The tubular conduit is a 3000-foot liner weighing 26 pounds per foot of length, for a total weight ($F_W$) of 78,000 pounds, and having an outside diameter of 7 inches. The example fluid in the borehole weighs 10 pounds per gallon, as does the fluid inside the liner. As such, the only buoyancy afforded the liner is the weight of the volume of fluid displaced by the steel wall of the liner itself, only 11,800 pounds of buoyancy ($F_B$). Subtracting the buoyancy from the liner weight results in a total buoyed liner weight of approximately 66,230 pounds. If the friction coefficient between the borehole wall and the liner is approximately 0.30, then the frictional force ($F_F$) resisting insertion of the liner is approximately 19,900 pounds.

EXAMPLE 2 (ILLUSTRATIVE)

A tubular conduit is inserted without rotation into a borehole at an inclination of 90 degrees relative to vertical, after evacuating the inserted conduit. The tubular conduit is a 3000-foot liner weighing 26 pounds per foot of length, for a total weight ($F_W$) of 78,000 pounds, and having an outside diameter of 7 inches. The example fluid in the borehole weighs 10 pounds per gallon. The liner has been plugged at both ends, and a vacuum (to the extent practical) exists in the liner. As such, the liner is subject to the buoyancy afforded by the weight of the volume of 10 pound per gallon borehole fluid displaced by the entire 7-inch diameter liner, a buoyancy force ($F_B$) of approximately 59,980 pounds. Subtracting this buoyancy from the liner weight results in a total buoyed liner weight of approximately 18,020 pounds. If the friction coefficient between the borehole wall and the liner is approximately 0.30, then the frictional force ($F_F$) resisting insertion of the liner is approximately 5,405 pounds, much less than the resistance of approximately 19,900 pounds in the un-evacuated case.

Although preferred embodiments of the invention have been shown and described (each embodiment is preferred for different well conditions and applications), changes and modifications may be made thereto without departing from the invention. Accordingly, it is intended to embrace within the invention all such changes, modifications and alternative embodiments as fall within the spirit and scope of the appended claims.

The invention claimed is:

1. A method for inserting a conduit into a well borehole penetrating a subterranean formation, the method comprising the steps of:

a) plugging a section of conduit with an upper plug and a lower plug;

b) evacuating the plugged section of conduit;

c) placing the conduit, leading with the plugged section, at the desired placement location within the borehole; and d) allowing fluid to flow into the plugged section of conduit.

2. The method of claim 1, wherein additional fluid-filled conduit sections are attached to the upper end of the plugged section of conduit.

3. The method of claim 2, wherein the upper plug is designed to slide to a lower end of the plugged section after the plugged section is placed at the desired placement location.

4. The method of claim 2, wherein the upper plug has a built-in valve designed to open after the plugged section is placed at the desired placement location.

5. The method of claim 2 wherein the upper plug has a built-in valve designed to open at a pressure above a certain threshold.

6. A method for inserting a conduit into a deviated borehole penetrating a subterranean formation, the method comprising the steps of:

a) plugging a section of the annulus between the conduit and an insertion string with an upper plug and a lower plug;

b) evacuating the plugged section;

c) placing the conduit, leading with the plugged section, at the desired placement location within the borehole; and d) allowing fluid to flow into the plugged section.

7. The method of claim 6, wherein the upper plug is designed to slide to a lower end of the plugged section after the plugged section is placed at the desired placement location.

8. The method of claim 6, wherein the upper plug has a built-in valve designed to open after the plugged section is placed at the desired placement location.

9. The method of claim 6 wherein the upper plug has a built-in valve designed to open at a pressure above a certain threshold.

10. A method for inserting a conduit into a deviated borehole penetrating a subterranean formation, the method comprising the steps of:

a) securing an insertion string co-axially within the conduit;

b) plugging a section of the insertion string with an upper plug and a lower plug;

c) evacuating the plugged section of the insertion string;

d) placing the conduit at the desired placement location within the borehole; and e) allowing fluid to flow into the plugged section.

11. The method of claim 10, wherein the upper plug is designed to slide to a lower end of the plugged section after the plugged section is placed at the desired placement location.

12. The method of claim 10, wherein the upper plug has a built-in valve designed to open after the plugged section is placed at the desired placement location.

13. The method of claim 10 wherein the upper plug has a built-in valve designed to open at a pressure above a certain threshold.

* * * * *